United States Patent [19]

Rodda

[11] 4,422,395

[45] Dec. 27, 1983

[54] THREAD HANDLING ARRANGEMENT WITH FIBER CARRYING STRIP AND CAM

[75] Inventor: Donald Rodda, Butler, N.J.

[73] Assignee: The Singer Company, Stamford, Conn.

[21] Appl. No.: 357,446

[22] Filed: Mar. 12, 1982

[51] Int. Cl.[3] ..... D05B 49/00

[52] U.S. Cl. ..... 112/254; 112/250

[58] Field of Search ..... 112/302, 250, 254, 241; 139/213, 214

[56] References Cited

U.S. PATENT DOCUMENTS

| | | | |
|---|---|---|---|
| 171,558 | 12/1875 | Gibbs . | |
| 276,113 | 4/1883 | Willcox et al. . | |
| 331,026 | 11/1885 | Bigelow . | |
| 908,434 | 12/1908 | Woodward . | |
| 1,975,019 | 9/1934 | Pavia | 139/213 |
| 3,561,385 | 2/1971 | Johnson . | |
| 3,587,495 | 6/1971 | Johnson . | |
| 4,263,859 | 4/1981 | Johnson . | |
| 4,341,171 | 7/1982 | Johnson | 112/250 |

OTHER PUBLICATIONS

U.S. Pat. Appln. S/N 259,299, dated Apr. 30, 1981.

*Primary Examiner*—Louis Rimrodt
*Assistant Examiner*—Andrew M. Falik
*Attorney, Agent, or Firm*—William V. Ebs; Robert E. Smith; Edward L. Bell

[57] ABSTRACT

A sewing machine is provided with a thread handling device including an elongate rigid member and a strip from which resilient fibers extend outwardly to contact thread passing between the rigid member and strip, and with a thread engaging cam which prevents a premature descent in said device and improperly formed stitches resulting therefrom.

7 Claims, 5 Drawing Figures

THREAD HANDLING ARRANGEMENT WITH FIBER CARRYING STRIP AND CAM

BACKGROUND OF THE INVENTION

The invention is directed to a thread handling arrangement for use in lockstitch sewing machines.

DESCRIPTION OF THE PRIOR ART

U.S. Pat. No. 4,263,859 of Ralph E. Johnson for "Thread Handling System for a Sewing Machine", issued Apr. 28, 1981 discloses a thread handling system which includes a thread handling device with elongate members that serve to hold and to meter needle thread to a needle and looptaker of a lockstitch sewing machine. The system further includes a thread tensioner. Thread from a spool extends to the thread tensioner, and beyond the tensioner the thread extends to the thread handling device. Beyond the thread handling device, the thread extends to the needle. A takeup which brackets the thread handling device sets stitches and pulls thread through the tensioner. The takeup moves the thread in one direction in the thread handling device to a stitch position at one end of its operating range, and moves in the opposite direction free of thread to the other end of its operating range, after which thread in the device moves to a position of reengagement with the takeup to shorten the path for thread between the tensioner and needle such that a quantity of thread is thereby supplied for use by the needle and looptaker. Copending patent application Ser. No. 259,299, of Ralph E. Johnson U.S. Pat. No. 4,341,171 for "Thread Handling Device for Lockstitch Sewing Machines" filed Apr. 30, 1981 discloses such a thread handling system in which a thread handling member is provided with a compressible resilient cellular material to engage the thread.

It is a prime object of the present invention to provide a thread handling arrangement of the kind disclosed for use on a sewing machine in the aforementioned patent and patent application with an improved thread handling device which applies only a light restraining force to thread moving through it, and with camming means effective to prevent an initial rapid descent of thread in the device resulting in slack thread and improperly formed stitches.

It is another object of the invention to provide a sewing machine with an improved thread handling device which applies only a very light restraining force to thread and which is associated with a thread engageable cam that increases thread tension in a predetermined manner only during the movement of thread in said device in one direction in response to the demand for thread by a needle and looptaker.

It is still another object of the invention to provide a cam which, in association with a thread handling device, increases thread tension as described and serves as a shield for the said device.

Other objects and advantages of the invention will become apparent during a reading of the specification taken in connection with the accompanying drawings.

SUMMARY OF THE INVENTION

In accordance with the invention, a thread handling device for a sewing machine is provided with a rigid elongate member and a fiber supporting strip from which resilient fibers project outwardly into contact with thread passing between the rigid member and strip.

The fibers apply only a light restraining force to the thread. A thread engaging cam prevents a premature descent of thread in the thread handling device resulting in slack thread and the formation by the machine of improperly formed stitches. The cam also increases tension in the thread during the downward movement of thread in the device as required for the thread to be forced into a looptaker hook and past bobbin case hold down means. In addition, the cam influences movement of the thread in the thread handling device in a manner causing the thread to move across such fibers only near their outer edge to prevent abrasion of the fibers and thread.

DESCRIPTION OF THE PREFERRED EMBODIMENT

Figure 1:
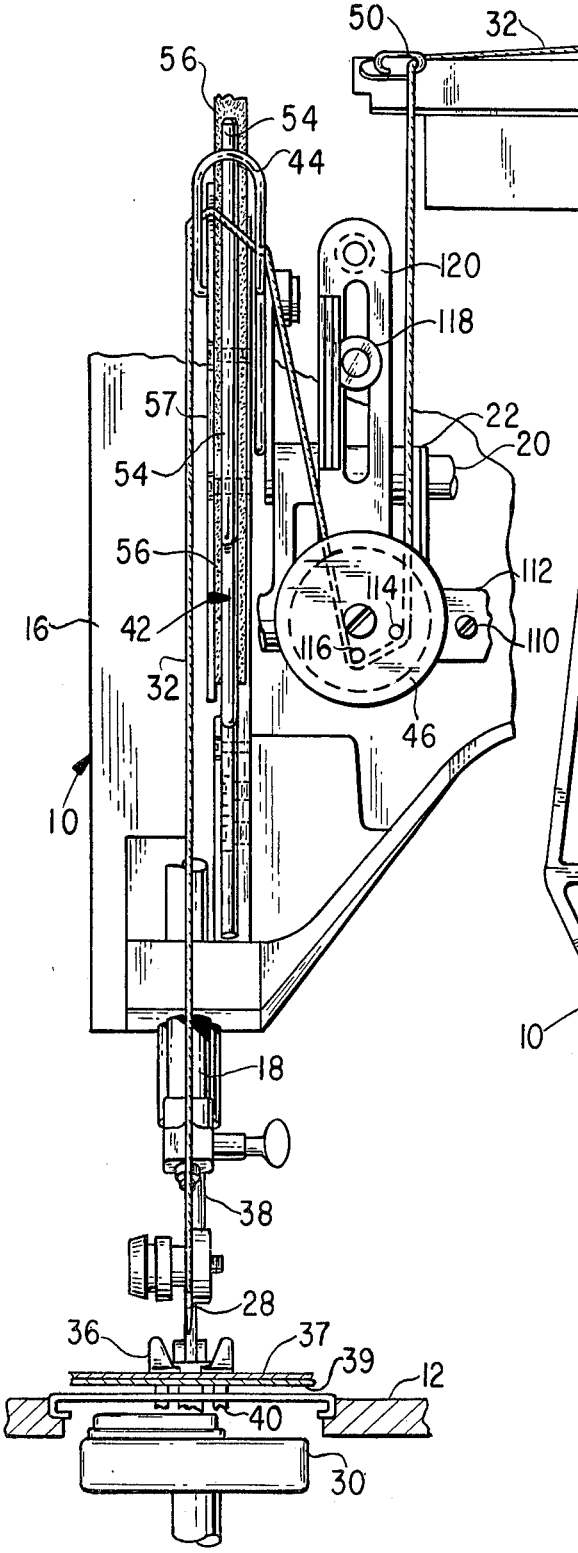
FIG. 1 is a front elevational view of a head end portion of a sewing machine with portions broken away to show the thread handling arrangement of the invention.
Figure 2:
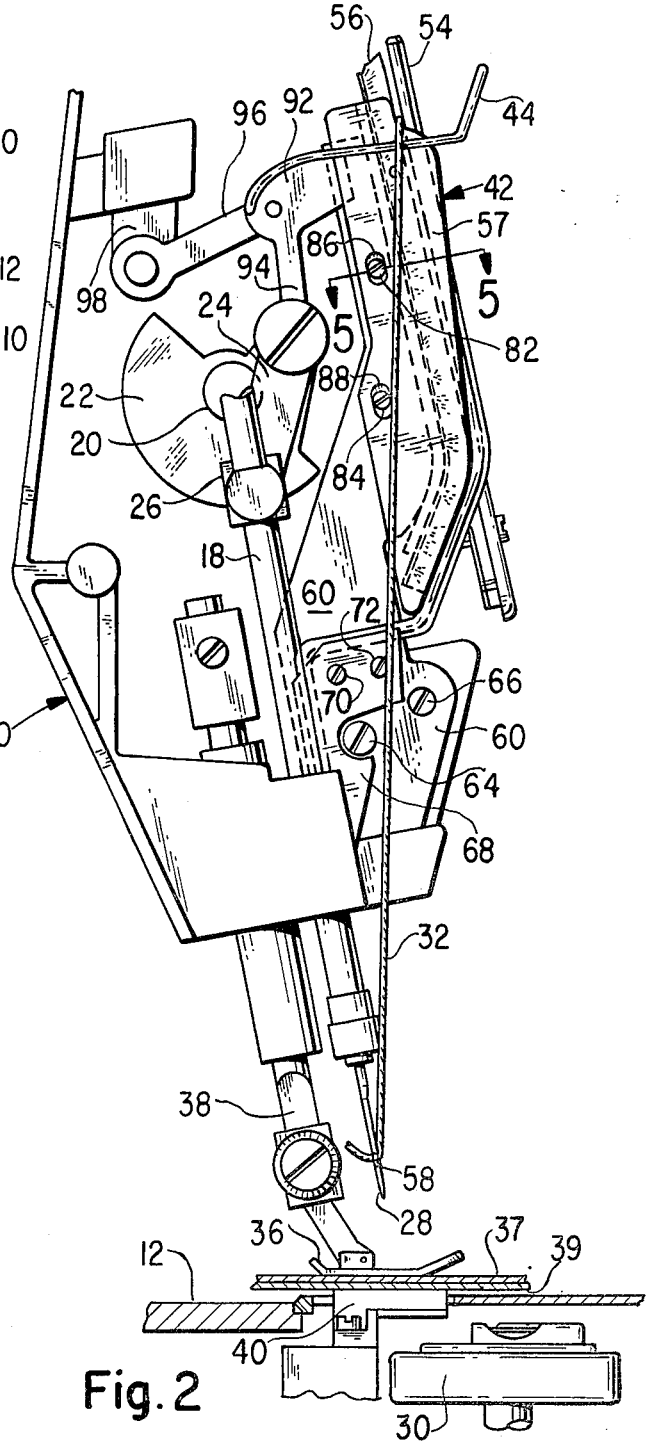
FIG. 2 is an end elevational view of the head end portion of the machine with the cover removed.

Referring to the drawings and in particular to FIGS. 1 and 2, reference character 10 designates a portion of a lockstitch sewing machine including a work supporting bed 12 and sewing head 16. A needle bar 18 is carried in the sewing head for endwise reciprocation by a rotating arm shaft 20 acting through a counterbalanced crank 22, a connecting drive link 24 and finally a collar 26 which is pivotally connected to the needle bar. A sewing needle 28 is carried by the lower end portion of the needle bar 18 and cooperates with a rotary looptaker 30 journalled in the bed and driven in timed relationship to the arm shaft in a well known manner for concatenating needle thread 32 to form lockstitches with bobbin thread (not shown). A detailed description of the manner in which such lockstitches are formed may be found, for example, in U.S. Pat. No. 2,862,468 of R. E. Johnson for "Ornamental Stitch Sewing Machines" issued Dec. 2, 1958 and assigned to The Singer Company. A presser foot 36, affixed to a presser bar 38 is utilized to urge fabric 37 and 39 into contact with a feed dog 40 by means of which work is advanced under the needle 28. The feed dog is moved in timed relationship to the needle and looptaker by conventional work feeding mechanism which may be of the type shown and described, for example, in U.S. Pat. No. 3,527,183 for "Work Feeding Mechanism for Sewing Machines" of The Singer Company, issued Sept. 8, 1972.

Thread 32 is supplied to the needle 28 by a thread handling device 42 shown in association with a takeup member 44 and a thread tensioner 46. The thread extends from a spool (not shown) through thread guides 48 and 50 to tensioner 46. The thread passes through the thread tensioner and thence into the thread handling device 42 where it passes between elongate members 54 and 56 of the device and over a cam 57 provided on the device. As shown, the thread extends over takeup member 44 which brackets the said members 54 and 56. Beyond the thread handling device 42 and takeup member 44, the thread extends to the needle where it is threaded through the eye 58. The thread 32 is moved upwardly in the thread handling device by the takeup 44, and is moved downwardly in the device free of the takeup.

Elongate member 54 is affixed in the head end of the machine between: (1) a plate 60 which is secured to fixed head end frame structure 62 by screws 64 and 66; and (2) a gusset plate 68 which is tightened against member 54 by screws 70 and 72 extending into structure 62. Elongate member 56 is comprised of individual fibers 74 which extend outwardly from a backing strip 76. The backing strip is secured with a suitable adhesive to a holder 78 along a frontal edge 80 thereof. Cam 57 which is shown as an integral part of holder 78 projects for most of its length beyond member 56. The holder 78 is affixed to plate 60 with screws 82 and 84 extending through elongate holder slots 86 and 88 permitting adjustment of the holder. The fibers 74 of members 56 are preferably of a synthetic plastic material such as polypropolene, "Dacron" or "Nylon", although natural bustles may be used in their place. The backing strip 76 is preferably of a flexible plastic material although any other material suitable for holding the fibers may also be utilized. Holder 78 is affixed with the screws 82 and 84 in a position causing the fibers 74 on member 56 to bear lightly against elongate member 54 which is shown in the form of a bent cylindrical rod.

Takeup member 44 and actuating mechanism therefor correspond to like functioning mechanism shown and described in the aforementioned U.S. Pat. No. 4,263,859 of Ralph E. Johnson. The takeup member 44 is affixed to an arm 92 at one end of a link 94 which has its other end pivotally connected to crank 22. A link 96 pivotally connects at one end to the link 94 as shown, and pivotally connects at the opposite end to a fixed member 98. Rotation of the arm shaft 20 results in link 94 being driven by crank 22, and the link 94 guided in its motion by the link 96 imparts reciprocatory up-down motion to the takeup member 44 along the elongate members 54 and 56 in timed relationship to the operation of the needle 28 and looptaker 30. The takeup member 44 includes thread carrying arms 100 and 102 which extend past thread exiting and thread entering sides respectively, of the thread handling device 42, and the interconnect at 104 across the front of the device. The arms 100 and 102 are angled to define thread carrying troughs 106 and 108 between diverging portions.

The thread tensioner 46 is mounted on the face of the machine by a screw 110 which engages a rigid bracket 112 of the device and extends into the sewing head 16. The thread tensioner 46 is disposed to one side of the thread handling device 42 in a position relative to the operating range of the takeup member 44 (as described in Ralph E. Johnson's U.S. Pat. No. 4,263,859). Thread 32 extending through the tensioner 46 passes around pins 114 and 116 therein and between tension applying plates. Tension applied by thread tensioner 46 may be variably controlled in accordance with the position of a knob 118 slidable along resilient member 120.

Figure 3:
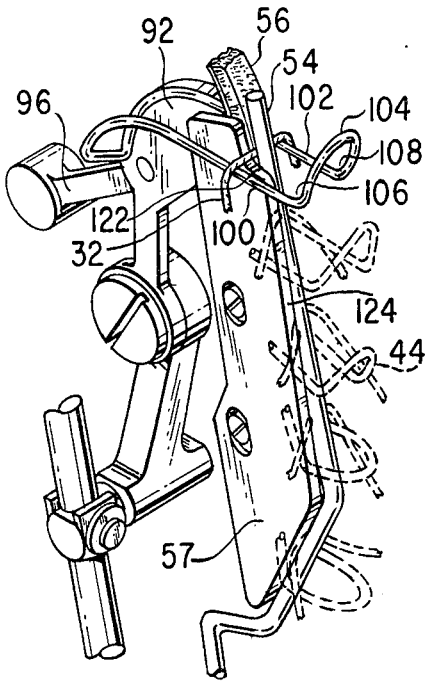
FIG. 3 is a perspective view showing the thread in various positions during descent in the thread handling arrangement.

During the operation of the machine, the takeup member 44 is moved up and down in timed relation to rotation of the looptaker 30 as described in the said U.S. Pat. No. 4,263,859 of Ralph E. Johnson. When the takeup member is at the top of its operating range, thread 32 is at its uppermost position in device 42 between members 54 and 56, and at its highest position on cam 57 where the thread then extends across a gradual slope 122 on the edge 124 of cam 57 near its upper end. When the takeup member starts to move downwardly from the top of its operating range, thread 32 is temporarily retained in such positions by the combined restraint on the thread of the fibers 74 and the cam 57 at slope 122 (see FIG. 3). The thread is thereby prevented from dropping prematurely, that is before needed by the needle and looptaker, with a consequential formation of half-hitched stitches. When thread is demanded by needle 28 and looptaker 30 as described in said U.S. Pat. No. 4,263,859, during the downward movement of the takeup member, the thread is drawn downwardly across fibers 74 as well as along the edge 124 of cam 57.

The gradual slope 122 on cam edge 124 near the upper end of cam 57 assures the maintenance during an initial portion of the descent of the thread in device 42, of thread tension as required to cause the thread to be forced into the looptaker hook and past bobbin case hold down means. The cam edge projects for most of its length beyond the fibers 74, and so permits thread moving downwardly through device 42 to travel across the fibers only near their outer edge, the effect of which is to limit tension applied by the fibers to the thread and prevent excessive abrasion of both the fibers and thread.

Figure 4:
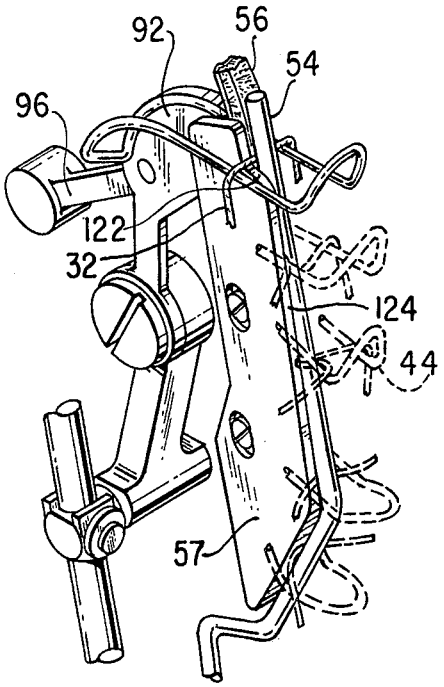
FIG. 4 is a view similar to FIG. 3 showing the thread in various positions during upward movement in the thread handling arrangement.
Figure 5:
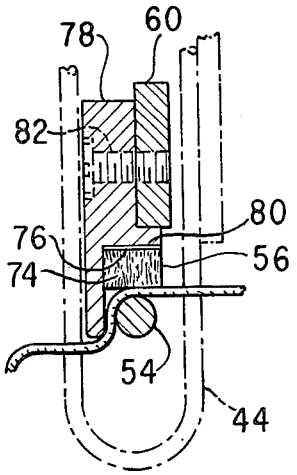
FIG. 5 is a sectional view taken on the plane of the line 5—5 of FIG. 2.

The descending thread is eventually reengaged by the takeup member 44 and moved upwardly between members 54 and 56 to its temporary retention position. As the takeup member moves upwardly in the device, slack thread cast off the looptaker is pulled upwardly by the takeup to provide for the formation of a stitch in the material being sewn. The slack is quickly removed by the takeup member because the fibers exert such a light frictional force on the thread, and so avoid excessive thread tension such as would otherwise result in slippage through the thread tensioner 46 and the pulling of thread from a supply spool in advance of stitch setting. The prompt removal of the slack being advantageous because thread is thereby removed from the vicinity of the looptaker before it can twist and prevent proper stitch formation. During the upward movement of the takeup member, the thread is pulled outwardly relative to the fibers 74 by the takeup member (see FIG. 4) and therefore only outer ends of the fibers contact the thread.

During the normal motor driven operation of the machine as described, the takeup member 44 is moved in response to rotation of shaft 20 in a clockwise direction as viewed in FIG. 2. If an operator should happen to rotate shaft 20 in the opposite direction with the usual handwheel of the machine the takeup member is moved along a path in which arms 100 and 102, during upward movement of the member 44, are closer to the thread handling members 54 and 56 than when the machine is motor driven in the normal direction. At such times, the takeup member would cause the thread 32 to enter into the depths of the fibers 90 and move along member 56 close to the roots of the fibers resulting in serious fiber damage except for cam 57. Cam edge 124 by engagement with the thread prevents the thread from moving down into the fibers and so preserves the integrity of member 56.

It is to be understood that the present disclosure relates to a preferred embodiment of the invention which is for purposes of illustration only and is not to be construed as a limitation of the invention. Numerous alterations and modifications of the structure herein will suggest themselves to those skilled in the art, and all such modifications, and alterations which do not depart from the spirit and scope of the invention are intended to be included within the scope of the appended claims.

I claim:

1. In a sewing machine wherein a sewing needle and looptaker cooperate in the formation of lockstitches in a fabric, the combination comprising: a thread source, thread tensioning means to which thread extends from the thread source; a thread handling device into which thread extends from the tensioning device and beyond which the thread extends to the needle, the thread handling device including an elongate rigid member and a fiber supporting strip from which resilient fibers project outwardly into contact with said rigid member and the thread in the thread handling member; a takeup for setting stitches and pulling thread through the tensioning device from the supply, the takeup being movable in one direction with thread to a stitch setting position at one end of its operating range whereat the thread is disposed for temporary retention by said thread handling device, and movable in the opposite direction free of the thread to the other end of said operating range to enable thread to move in the thread handling device away from the temporary retention position to a position of reengagement with the takeup at said other end of its operating range and during such movement shorten the path for thread between the tensioning device and needle to supply a quantity of thread for use by the needle and looptaker; and a cam in the thread path between the thread handling device and needle, said cam being located with respect to the thread handling device to engage thread exiting from the thread handling device, the cam including a gentle slope at the extreme upper end of an effective edge of the cam on which descent of the thread from its temporary retention position is delayed.

2. The combination of claim 1 wherein the rigid member of the thread handling device is cylindrical, and the fiber supporting member is flexible and of a plastic material.

3. The combination of claim 1 wherein the fibers are of a resilient plastic material.

4. The combination of claim 1 wherein the fibers are of a polypropolene plastic.

5. The combination of claim 1 including a holder for the strip, the holder including the cam as an integral part thereof.

6. The combination of claim 1 wherein the cam is configured and disposed with respect to the thread handling device to permit the thread in the thread handling device to engage the fibers only at their outer ends.

7. The combination of claim 1 wherein a portion of the length of the cam projects beyond the rigid member of the thread handling device.

* * * * *